US011602235B2

(12) United States Patent
Harvey, Jr.

(10) Patent No.: US 11,602,235 B2
(45) Date of Patent: Mar. 14, 2023

(54) QUILT PANEL

(71) Applicant: Lenon Harvey, Jr., Palatka, FL (US)

(72) Inventor: Lenon Harvey, Jr., Palatka, FL (US)

( * ) Notice: Subject to any disclaimer, the term of this patent is extended or adjusted under 35 U.S.C. 154(b) by 99 days.

(21) Appl. No.: 17/110,606

(22) Filed: Dec. 3, 2020

(65) Prior Publication Data

US 2022/0175159 A1 Jun. 9, 2022

(51) Int. Cl.
*A47G 9/02* (2006.01)

(52) U.S. Cl.
CPC ..... *A47G 9/0207* (2013.01)

(58) Field of Classification Search
CPC ..... A47G 9/00; A47G 9/02; A47G 9/0207; A47G 9/0223; A47G 9/0238; A47G 9/0261; A47G 2009/0269; A47G 2009/0276
See application file for complete search history.

(56) References Cited

U.S. PATENT DOCUMENTS 1,118,220 A * 11/1914 Oplustil ..... A47G 9/0261 5/501
1,844,291 A * 2/1932 Markutsis ..... A47G 9/0261 5/501
2,821,723 A * 2/1958 Gluck ..... A47G 9/0238 D6/602
3,681,795 A * 8/1972 Palenske ..... A47G 9/02 5/497
4,172,300 A * 10/1979 Miller ..... A47G 9/0207 2/69.5
4,631,765 A * 12/1986 Casey ..... A47G 9/0207 428/33
5,187,825 A * 2/1993 Tesch ..... A47G 9/0207 5/482
5,713,089 A * 2/1998 Ferrante ..... A47G 9/0207 5/923
5,732,424 A * 3/1998 Bond ..... A47G 9/02 5/498
2005/0246838 A1* 11/2005 Wirtz ..... A47G 9/0261 5/501
2011/0252563 A1* 10/2011 Horstman ..... A47G 9/0207 5/486
2014/0317846 A1* 10/2014 Collins ..... A47G 9/0207 5/486
2015/0157147 A1* 6/2015 Haraszta ..... A47G 9/0261 5/501
2016/0058214 A1* 3/2016 Preston ..... A47G 9/0238 5/497
2016/0338513 A1* 11/2016 Mittal ..... A47G 9/0207
2019/0059618 A1* 2/2019 Jocic ..... A47G 9/04
2019/0282004 A1* 9/2019 Schwartz ..... A47G 9/0223

* cited by examiner

*Primary Examiner* — David R Hare
*Assistant Examiner* — George Sun
(74) *Attorney, Agent, or Firm* — Andrew Kenny

(57) ABSTRACT

This invention relates generally to a quilt panel as a cloth fragment which is connected to other cloth fragments to make a blanket or garment, or other such constructions. The quilt panel is devised to be joined to like quilt panels to make a blanket, rug, or garment. The quilt panel comprises: a polygonal inner portion within a same shape outer portion wherein a hemline joining face-to-face sheets of the outer portion extends from each corner of the inner potion to the closest corner of the outer portion to form trapezoid quilt pockets; and quilt flaps each with a connected side in common with one of the open sides of one of the quilt pockets.

17 Claims, 4 Drawing Sheets

QUILT PANEL

FIELD OF THE INVENTION

This invention relates generally to a quilt panel as a cloth fragment which is connected to other cloth fragments to make a blanket or garment, or other such constructions. The quilt panel is in the general field of crafts especially crafts to make blankets, garments, flags, rugs, toddler bumpers, pillow casings, facemasks and other items typically constructed from cloth or fabric.

BACKGROUND

Quilting is a method of making larger pieces from smaller quilt panels by joining the quilt panels edge to edge. Quilt panels with a variety of shapes may be joined to make interesting designs. Cloth or fabric may be used frugally and wisely as fragments of cloth that would otherwise be too small, may be combined as quilt panels in a larger blanket, garment, or rug.

PRIOR ART

Traditionally the smaller quilt panels are combined by sewing them together. Sewing enables fragment with diverse shapes to be combined. A quilt made by sewing the panels has a classic look and feel.

Quilters have made attempts to combine quilt panels with other techniques in part because quilters are crafts people who make quilts individually to get a look and feel specific for various applications. For example, publication U.S. Pat. No. 4,631,765 B (Casey) discloses panels which may be tied together or buttoned together relatively quickly compared to sewing. In another example, publication U.S. Pat. No. 5,713,089 B (Ferrante) discloses panels which may be connected by hook and loop type fasteners.

In light of the foregoing prior art, there is a need for a quilt panel to make blanket, garments, rugs with new designs in a new way.

SUMMARY OF THE INVENTION

According to a quilt panel to be joined to a like panel, comprising: a polygonal inner portion within a same shape outer portion wherein a hemline joining face-to-face sheets of the outer portion extends from each corner of the inner portion to the closest corner of the outer portion to form trapezoid quilt pockets each having an open side in common with a perimeter side of the outer portion; and quilt flaps each connected to the open side of one of the quilt pockets, wherein a first configuration at least one of the quilt flaps extends out from the one of the quilt pockets to which it is connected to be inserted in a like pocket of a like panel, and in a second configuration at least one of the quilt flaps is tucked into the one of the quilt pockets to which it is connected to arrange that quilt pocket receive a like flap of a like panel.

To make the quilt panel frugally and simply, the inner portion may comprise the same face-to-face sheets as the outer portion. The quilt flaps may also comprise the same face-to-face sheets as the outer portion. So for example the quilt panel may be constructed with just two face-to-face sheets. When a blanket or garment is made by joining like quilt panels, the area of the face to face sheets covering the inner portion and the outer portion will be visible.

The face-to-face sheets may comprise a first sheet of cloth, fabric, or woven or non-woven sheet-like material which covers or partially covers a second sheet of cloth, fabric, or woven or non-woven sheet-like material.

It advantageous to tuck the quilt flap into the quilt pocket intermediate the face-to-face sheets because the like flap received in the quilt flap may be connected to the quilt flap tucked in the quilt pocket. The like flap then cannot be pulled out of the quilt pocket without also pulling out the tucked in quilt flap and turning the quilt flap inside-out. So the quilt panel and joint panel may be stably joined so that a system of quilt panels joined to like panels reliably stays together.

Preferably the quilt panel and two face-to-face sheets are octagonal since the inner portion and the outer portion may then both have a square or rectangular perimeter. The inner portion may be square or rectangular in shape. So the same shape outer portion would also be square or rectangular. The quilt panel may be joined to four like quilt panels along the four sides of the square or rectangular portion of the quilt panel. So a system made from the quilt panel and like quilt panel appears to be comprised of joined square or rectangular panels because the inner and outer portions are visible while the flaps may not be.

The quilt panel and the two face-to-face sheets may be a six-side polygon such as a hexagon so that the inner portion is triangular in shape. When joined to other like quilt panels, this quilt panel will have a visible triangular inner portion and outer portion.

The flaps may have contiguous external edges which are respective polygonal sides of the quilt panel. This way the quilt panel can be made with, for example, simple to cutout hexagonal or octagonal face-to-face sheets. So, for example, the contiguous edges of the quilt flaps provide the quilt panel with an octagonal shape.

Typically the number of sides of the quilt panel is polygonal. The quilt panel may have twice as many sides as the polygonal inner portion. This way when a blanket or garment is made by joining the quilt panel and like quilt panels, the inner and outer portions having half the number of sides as the quilt panel and like quilt panels will be visible.

Each of the quilt flaps may have a trapezoidal shape. Preferably all the quilt flaps have the same shape and size. A trapezoid has two parallel edges. Preferably each of the quilt flaps has a trapezoidal shape with a longest parallel edge in common with one of the open sides of the quilt pocket to which it is connected.

The trapezoid quilt pockets have a trapezoidal shape. Preferably each of the trapezoid quilt pockets has its longest parallel edge in common with its open side. So the trapezoidal shaped quilt flaps of the quilt panel will fit in the trapezoidal quilt pockets of a like panel and vice versa when they are joined. Preferably the quilt pockets and quilt flaps have an isosceles trapezoid shape. The isosceles trapezoid shape is possible when the quilt panel has a hexagonal or octagonal shape with equal length sides.

The inner portion contains a first batting intermediate the face-to-face sheets which cover the outer portion and the inner portion. The outer portion may contain a second batting. The batting may provide the quilt panel with softness and insulation. It may also provide the quilt pocket walls with stiffness to ease tucking each quilt flap into each respective quilt pocket. The second batting may comprise a layer also in the first batting. This way the batting may be made simply by staking layers.

The quilt panel may comprise a second hemline through the face-to-face sheets, wherein the second hemline follows a polygonal line which coincides with the polygonal inner portion perimeter. Thus the inner portion may be surrounded by the second hemline so that batting or insulation in the inner portion cannot escape.

Preferably each quilt flap comprises a type one connector and a type two connector. A type one connector may be connected to a type two connector and vice versa. In this way a quilt panel may be connected to a like panel by a type one connector connected to a type two connector.

The type one connector and type two connector may be hook and loop type wherein the type one connector comprises hooks and the type two connector comprises loops. The connectors may be button—buttonhole type wherein the type one connector comprises a button and the type two connector is characterised by a buttonhole. The connectors may be a mortise and tenon snap together type where the type connector comprises the tenon and the type two connector comprises the mortise.

The type one connector and the type two connector may be in two respective locations of each flap. Preferably the type one connector is equidistant on a first side of a center line of the quilt panel and the quilt flap as a distance of the type two connector is from the center line of the quilt panel and the quilt flap.

Preferably the type one connector and the type two connector alternate. The type one connector and the type two connector may alternate going around the quilt panel. In this way a type one connector on a first quilt flap tucked into a quilt pocket in a second configuration is positioned to be in a same location as the type two connector on a second like flap of a like panel in a first configuration inserted in the quilt pocket. In this way the type two connector on the same first quilt flap tucked into the same quilt pocket is positioned to be in the same location as the type one connector on the same second like flap of the like panel.

According to a second aspect of the invention there is a quilt panel to be joined to a like panel, comprising: two octagonal sheets face-to-face connected along their eight sides and connected by four hemlines each one extending from the center of an alternating four sides of the eight sides orthogonal to the respective one of the four sides a distance substantially half the length of the respective one of the four sides to form four trapezoid pockets having a longest side in common with a respective trapezoid flap. The quilt pocket may be intermediate the face-to-face sheets, each quilt pocket open intermediate the hemlines along a base of the isosceles trapezoid. The base being the longer of the two parallel sides of the isosceles trapezoid. Thus a blanket or garment with a traditional look of square or rectangular visible portions may be made easily.

In another useful configuration the quilt panel to be joined to a like quilt panel, comprises: two like-size rectangular sheets having chamfered corner edges; the sheets face-to-face, connected along their common perimeter and connected by hemlines which extend orthogonally from the center of each chamfered corner edge a distance substantially half the length of the edge to form quilt pockets and isosceles trapezoid quilt flaps having a longer parallel side in common with the quilt pocket and a shorter parallel side in common with a parallel side of the rectangular sheet, wherein a first configuration the quilt flap extends from the common side to be inserted in a like pocket of a like quilt panel and in a second configuration the quilt flap is folded from the common side into the quilt pocket to receive a like flap of a like panel.

According to a third aspect of the invention there is a system of quilt panels, each the quilt panels comprising: a polygonal inner portion within a same shape outer portion wherein a hemline joining face-to-face sheets of the outer portion extends from each corner of the inner potion to the closest corner of the outer portion to form trapezoid quilt pockets each having an open side in common with a perimeter side of the outer portion; and quilt flaps each connected to the open side of one of the quilt pockets, wherein a first one of the quilt panels is in a first configuration in which at least a first one of the quilt flaps extends out from the one of the quilt pockets to which it is connected to be inserted in a like second one of the quilt pockets of a like second one of the quilt panels which is in a second configuration in which a like second one of the quilt flaps is tucked into the like second one of the quilt pockets to which it is connected.

According to a fourth aspect of the invention there is a method of making a system of quilt panels; each of the quilt panels comprising: a polygonal inner portion within a same shape outer portion wherein a hemline joining face-to-face sheets of the outer portion extends from each corner of the inner potion to the closest corner of the outer portion to form trapezoid quilt pockets each having an open side in common with a perimeter side of the outer portion; and quilt flaps each connected to the open side of one of the quilt pockets; wherein the method includes arranging a like second one of the quilt panels into a second configuration by tucking a like second one of the quilt flaps of the second quilt panels into a like second one of the quilt pockets to which it is connected and inserting a first quilt flap of a first one of the quilt panels which is in a first configuration in which at least the first one of the quilt flaps extends from the one of the quilt pockets to which it is connected. The invention will now be described, by way of example only, with reference to the accompanying figures in which:

DETAILED DESCRIPTION OF THE INVENTION

Figure 1:
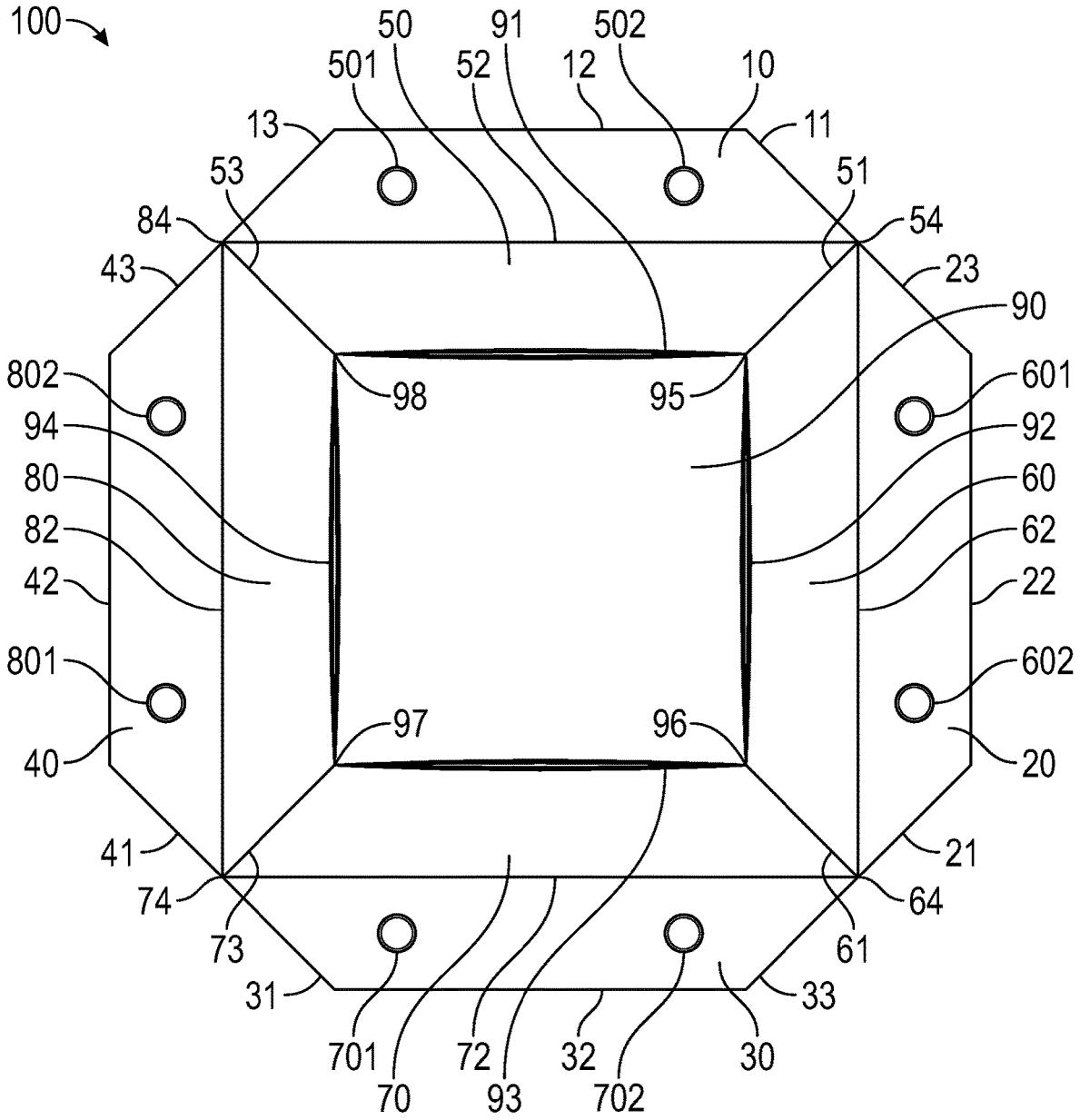
FIG. 1 shows a plan view of a quilt panel.
Figure 2:
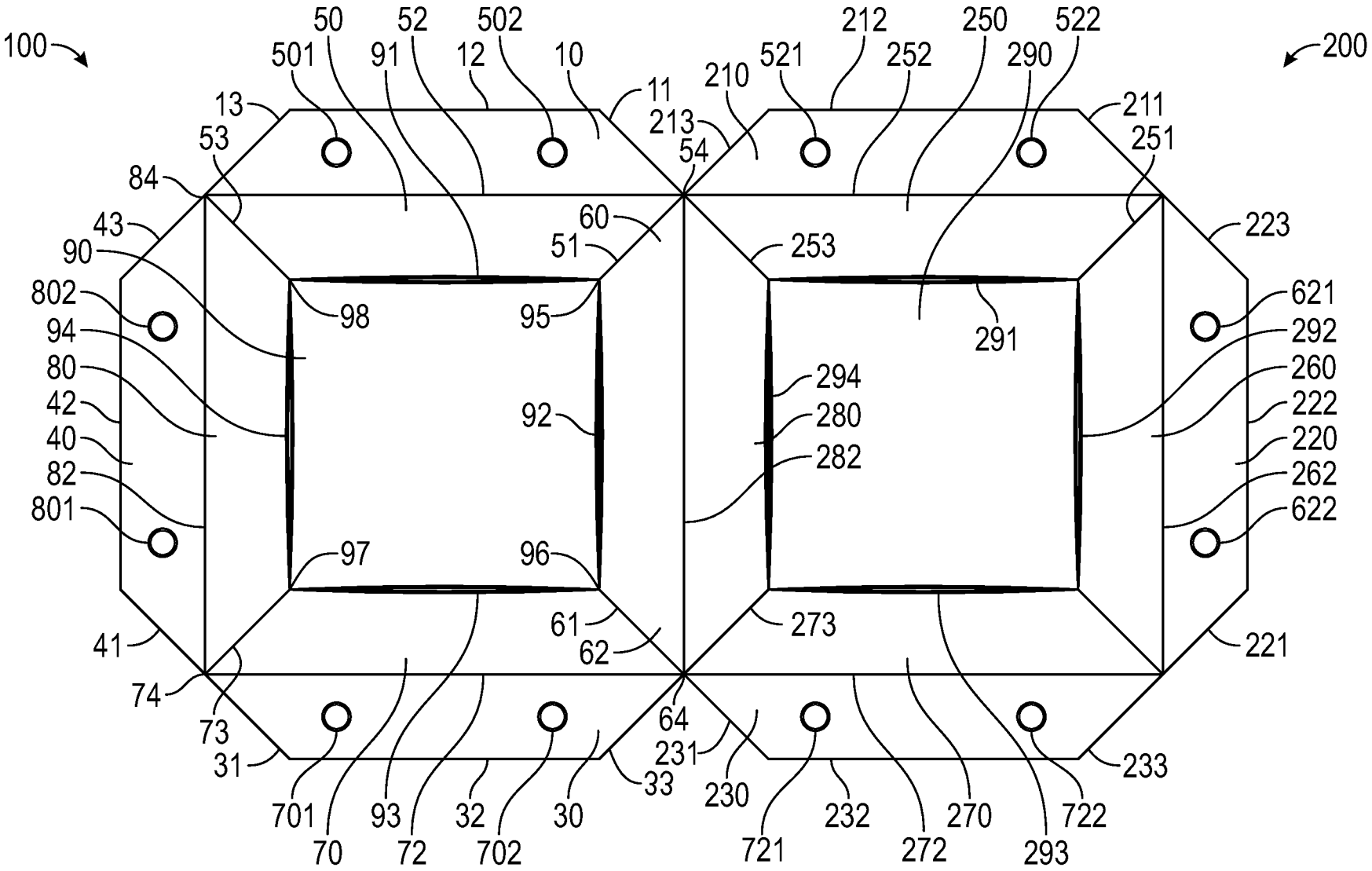
FIG. 2 shows a plan view of a quilt panel joined along a perimeter side of an outer portion to a like quilt panel.

Referring to the Figures, there is shown in FIG. 1 a quilt panel 100. In FIG. 2 the quilt panel 100 is shown joined to a like quilt panel 200.

The quilt panel 100 comprises a polygonal inner portion 90. In the examples shown in FIGS. 1, 2 and 3 the inner polygonal inner portion is square shaped. Other shapes such as a triangle, rectangle, pentagon and so forth are also possible.

Figure 3:
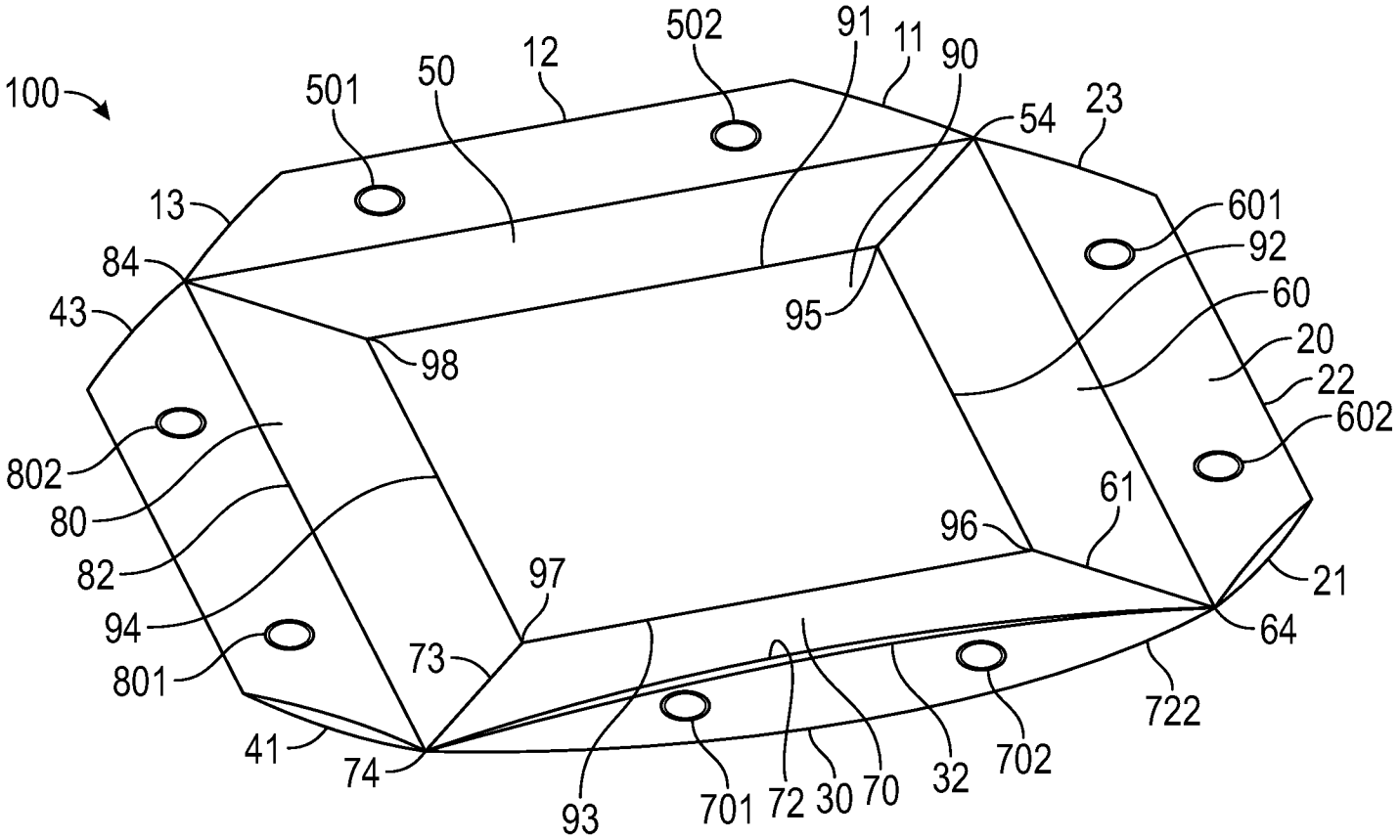
FIG. 3 shows a perspective view of quilt panel in a second configuration looking into an open side of a quilt pocket.

As shown in FIGS. 1, 2 and 3 the square shaped inner polygonal portion has four perimeter sides 91, 92, 93, 94. A first perimeter side 91 is a border of a first trapezoid quilt pocket 50. A second perimeter side 92 is a border of a second trapezoid quilt pocket 60. A third perimeter side 93 is a border of a third trapezoid quilt pocket 70. A fourth perimeter side 94 is a border of a fourth trapezoid quilt pocket 80. The perimeter sides 91,92, 93, 94 coincide with the shorter one of the two parallel sides of the respective trapezoidal quilt pocket 50, 60, 70, 80.

The square shaped inner portion 90 is centered within a same shape outer portion which has a square shaped border of four perimeter sides 52, 62, 72, 82.

The outer portion of that can be seen as four trapezoid quilt pockets 50, 60, 70, 80 which are outside the borders of the square shaped inner portion 90. Each one of the four perimeter sides 52, 62, 72, 82 of the outer border of the square shape outer portion coincides with the longer one of the two parallel sides of the respective trapezoidal quilt pocket 50, 60, 70, 80.

The outer portion with perimeter sides 52, 62, 72, 82 comprises two sheets face-to-face. It is possible for both the inner portion 90 and the outer portion to comprise the same two sheets. In FIG. 3, the third trapezoid quilt pocket 70 is shown open and a portion of the top one of the two sheets can be seen above the bottom one.

Four hemlines 51, 53, 61, 73 join the two face-to-face sheets of the outer portion. Each hemline 51, 53, 61, 73 extends from each corner 95, 96, 97, 98 of the inner portion 90 to the closest corner 54, 64, 74, 84 of the outer portion to form trapezoid quilt pockets 60, 70, 80, 90. The hemlines 51, 53, 61, 73 are lines of stitching, glue, tape, plastic welding or other type of joint which connect the two face-to-face sheets.

Four more hemlines are optional along the four sides 91, 92, 93 and 94 of the inner portion 90. These hemlines may be used to close off the interior of the square inner portion which is intermediate the two face-to-face sheets. This way the interior may hold batting or stuffing as insulation and to make the quilt panel comfier. The batting or stuffing is usually an eighth inch, or a quarter inch or a half inch thick. In square inner portion may be two between and a hundred square inches in area.

The four sides 52, 62, 72, 82 of the square shape outer portion do not have a hemline that joins the two face-to-face sheets. There is no joint between the two face-to-face sheets along the four sides 52, 62, 72, 82. So the two face-to-face sheets can be separated along the four sides 52, 62, 72, 82 to make openings into the four trapezoid quilt pockets. 50, 60, 70, 80. This can be seen, for example, in FIG. 3 where the third trapezoid quilt pocket 70 has top sheet side 72 separated from bottom sheet side 74. This also shows that the open side 72 the trapezoid quilt pocket 70 is in common with the perimeter side 72 of the outer portion.

The is usually a batting lining the two face-to-face sheets in the of the outer portion to provide the trapezoid quilt pocket 50, 60, 70, 80 walls with softness. The batting in the outer portion is usually less thick than in the inner portion and is usually one sixteenth of an inch thick. In the quilt flaps 10, 20, 30, 40 there is usually even less or no insulation.

The quilt panel 100 has four quilt flaps 10, 20, 30, 40 which can be seen in FIGS. 1, 2, 3 and 4. Each quilt flap 10, 20, 30, 40 is connected to a respective one of the of the open sides 52, 62, 72, 82 of each trapezoid quilt pocket 50, 60, 70, 80. So each quilt flap 10, 20, 30, 40 has a flap side 52, 62, 72, 82 in common with one of the open side 52, 62, 72, 82.

The trapezoid quilt pockets 50, 60, 70, 80 and quilt flaps 10, 20, 30, 40 enable a quilt panel 100 to be joined to a like panel 200 which has like pockets 250, 260, 270, 280 and like flaps 210, 220, 230, 240. This can be seen for example in FIG. 2.

Figure 4:
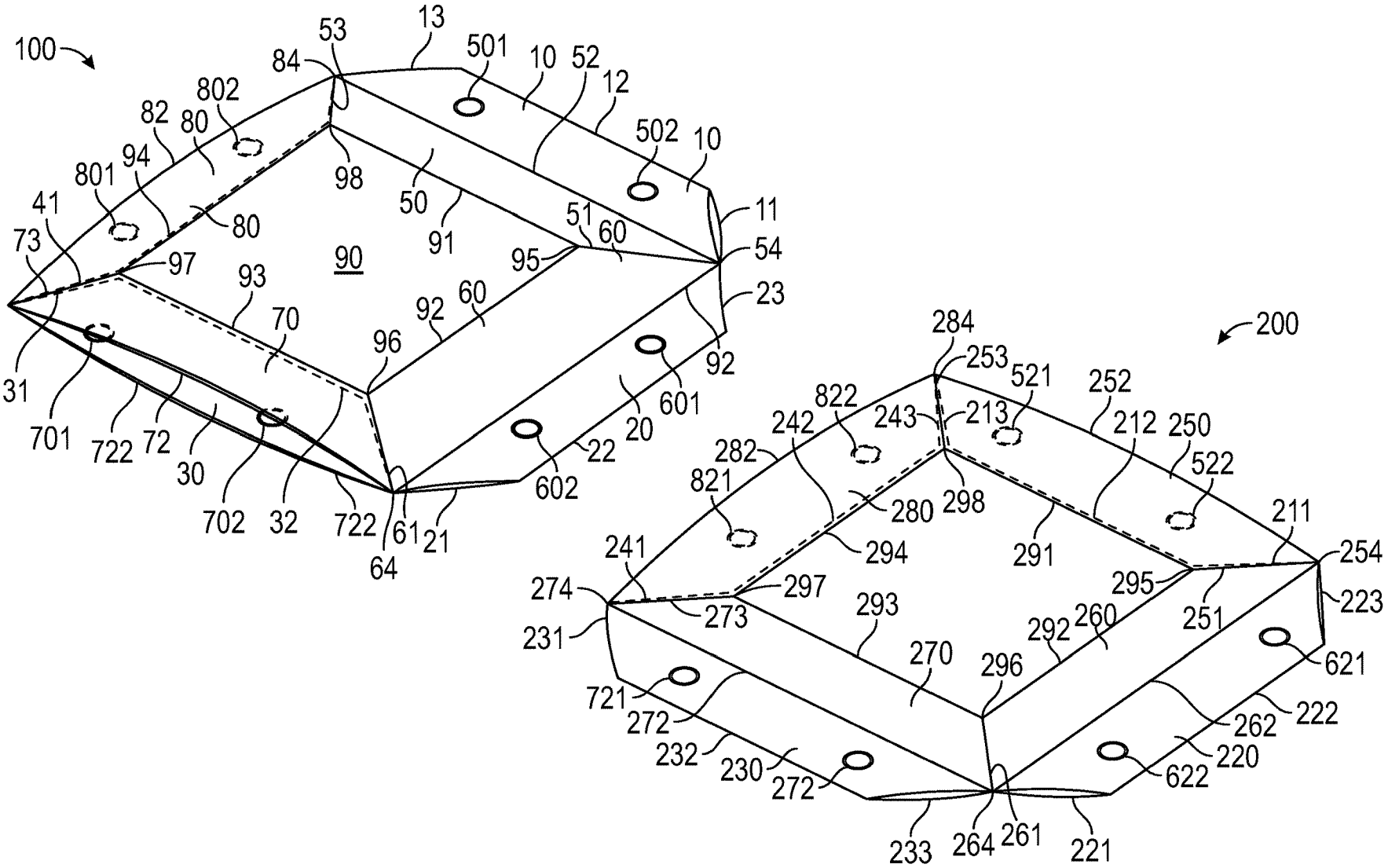
FIG. 4 shows a perspective view of a quilt panel in first configuration positioned to be joined to a like panel in a second configuration.

In FIG. 4, the quilt panel 100 may be seen positioned to be joined to the like panel 200. The quilt flap 20 is positioned to be inserted into like pocket 280. Annotation numbers in FIG. 2 and FIG. 4 show quilt features with numbers 'xx' on the quilt panel 100. Like features have numbers '2xx' on the like panel 200. For example quilt flap 20 on the quilt panel 100 has a like feature on the like panel which is annotated as like flap 220 on the like panel 200. Quilt pocket 60 on the quilt panel 100 has a like pocket 260 on the quilt panel 200. Other corresponding pairs of (quilt:like) features include, for example: (13:213), (12, 212), (11:211), (501:521), (502:522), (50:250), (51:250), (52:252), (53:253), (54:254), (84:284), (98:298), (91:291), and (95:295).

To facilitate being joined to a like panel 200, the quilt panel 100 is arranged in a first configuration. Referring to FIG. 1, the quilt panel 100 is in the first configuration. The quilt panel 100 has all four quilt flaps 10, 20, 30, 40 arranged so that they extend from the open side 52, 62, 72, 82 of each respective quilt pocket 50, 60, 70, 80. So for example as shown in FIG. 2, quilt flap 20 can be inserted through an open side 282 of a like pocket 280 of like quilt panel in a second configuration. To put a quilt panel into a second configuration, a quilt flap 10, 20, 30, 40 may be folded into a respective quilt pocket 50, 60, 70, 80 by turning the two face-to-face sheets inwards in a similar fashion as a sock toe may be turned inside out into a foot portion of a socket. An illustration of a quilt panel 100 in a second configuration is shown in FIG. 3. The open side 72 of the third trapezoid quilt pocket 70 is opened wide as the top sheet is separated from the bottom sheet. The third quilt flap 30 is tucked in through the open side 72 and so tucked into the third trapezoid quilt pocket 70. The third quilt flap 30 is thereby tucked out of the way of the open wide opening into the open side 72. So a like flap, for example like flap 210 could be inserted into the open wide opening and into the third trapezoid quilt pocket.

Referring to FIGS. 2 and 4 it is possible for a quilt panel 100 to have a first quilt flap 20 which extends from a first quilt pocket 60 to which it is connected. A second quilt flap 30 is folded into a second quilt pocket 70 to which it is connected. The first quilt flap 20 extends from the first quilt pocket 60 as is the first configuration. The second quilt flap 30 is tucked into the second quilt pocket 70 as is the second configuration. The first quilt flap 20 which extends from the first quilt pocket 60 of the quilt panel 100 is positioned to be joined to a like panel 200. The like panel 200 has a third like pocket 240 in which a connected like flap is tucked. So the third like pocket 240 is positioned and arranged to receive the first quilt flap 20. In this way the quilt panel 100 is joined to the like panel 200.

After a quilt flap 10, 20, 30, 40 is inserted into a like pocket 250, 260, 270, 280, the quilt flap must be fastened to the like pocket to hold the quilt panel 100 and the like panel 200 together. Each quilt flap has a type one connector and a type two connector side by side in a row parallel with the quilt flap side in common with the respective open side. For example the first quilt flap 10 has a first type one connector 501 beside a first type two connector 502; the second quilt flap 20 has a second type two connector 601 beside a second type one connector 602; the third quilt flap 30 has a third type one connector 702 beside a third type two connector 701; and the fourth quilt flap 40 has a fourth type two connector 801 beside a fourth type one connector 801. The snaps are in the same location on each quilt flap. Adjacent quilt flaps have male and type two connectors in alternate positions. So for example, going clockwise around the quilt panel 100 the first quilt flap 10 has a first type one connector 501 then a first type two connector 502; then second quilt flap 20 has a second type two connector 601 beside a second type one connector. This way a type one connector will always align with a type two connector when a quilt panel is joined to a like quilt panel.

In the examples shown in FIGS. 1, 2 and 3 the quilt panel 100 and like panel 200 have octagonal shapes with all eight sides of the quilt panel perimeter having same length. So in these examples the quilt panel 100 to be joined to a like quilt panel, comprises: two octagonal sheets face-to-face connected along their common eight edges 11, 23, 22, 21, 32, 31, 41, 42, 43, 13 and connected by four hemlines 51, 61, 73, 53 each hemline extending from the center 54, 64, 74, 84 of four alternate edges (10, 23), (21, 33), (31, 41), (43, 13) orthogonal to the alternate edge a distance substantially half the length of the edge to form four quilt pockets 50, 60, 70, 80 intermediate the sheets, each quilt pocket open intermediate the hemlines 51, 61, 73, 53 along a base 91, 92, 93, 94 of an isosceles trapezoid.

The foregoing is considered as illustrative only of the principles of the invention. Accordingly, all suitable modifications and equivalents may be resorted to, falling within the scope of the claims.

The invention claimed is:

1. A first quilt panel to be joined to a second like quilt panel, the first quilt panel comprising: a polygonal inner portion within a same shape outer portion wherein hemlines joining face-to-face sheets of the outer portion extend from each corner of the inner portion to the closest corner of the outer portion to form trapezoid quilt pockets intermediate the face-to-face sheets, each of the trapezoid quilt pockets having an opening through an open side in common with a perimeter side of the outer portion outer border; and quilt flaps each connected to the open side of one of the trapezoid quilt pockets, each one of the quilt flaps has a trapezoidal shape with a longest parallel edge of the trapezoidal shape in common with the one of the open sides of the trapezoid quilt pocket to which it is connected, wherein a first configuration of the first quilt panel at least one of the quilt flaps extends out from the one of the trapezoid quilt pockets to which it is connected to be inserted in a like trapezoid quilt pocket of the second like quilt panel, and in a second configuration of the first quilt panel at least one of the quilt flaps is tucked through the opening into the one of the trapezoid quilt pockets to which it is connected to arrange that quilt pocket receive a like flap of the second like quilt panel.

2. The first quilt panel according to claim 1, wherein the inner portion comprises the same face-to-face sheets as the outer portion.

3. The first quilt panel according to claim 1, wherein the quilt flaps comprise the same face-to-face sheets as the outer portion.

4. The first quilt panel according to claim 1 wherein the inner portion is rectangular in shape.

5. The first quilt panel according to claim 1 wherein the inner portion is triangular in shape.

6. The first quilt panel according to claim 1 wherein the quilt flaps have contiguous external edges which are respective polygonal sides of the quilt panel.

7. The first quilt panel according to claim 1 wherein contiguous edges of the quilt flaps provide the quilt panel with an octagonal shape.

8. The first quilt panel according to claim 1 wherein the first quilt panel is polygonal having twice as many sides as the polygonal inner portion.

9. The first quilt panel according to claim 1 wherein each of the trapezoid quilt pockets has a longest parallel edge in common with its open side.

10. The first quilt panel according to claim 1 wherein the trapezoid quilt pockets and the quilt flaps have an isosceles trapezoid shape.

11. The first quilt panel according claim 1 wherein the inner portion contains a first batting intermediate the face-to-face sheets which cover the outer portion and the inner portion.

12. The first quilt panel according to claim 1 where the outer portion contains a second batting.

13. The first quilt panel according to claim 1 wherein the inner portion contains a first batting intermediate the face-to-face sheets which cover the outer portion and the inner portion, and the outer portion contains a second batting which comprises a layer also in the first batting.

14. The first quilt panel according to claim 1 wherein the inner portion comprises the same face to face sheets as the outer portion and further comprising a second hemline through the face-to-face sheets, wherein the second hemline follows a polygonal line which coincide with the polygonal inner portion perimeter.

15. The first quilt panel according to claim 1 wherein each quilt flap comprises a type one connector and a type two connector in two respective locations which are equidistant on either side of a center line of the quilt panel and the quilt flap, wherein the type one connector is connectable to the type two connector and vice versa.

16. A system of quilt panels comprising a first quilt panel and a second like quilt panel each according to claim 1, wherein the first quilt panel is in the first configuration in which at least a first one of the quilt flaps extends out from the one of the trapezoid quilt pockets to which it is connected to be inserted in a like second one of the trapezoid quilt pockets of the second like quilt panel which is in the second configuration in which a like second one of the quilt flaps is tucked into the like second one of the trapezoid quilt pockets to which it is connected.

17. A method of making the system of quilt panels according to claim 16, wherein the method includes arranging the second like quilt panel into the second configuration by tucking the like second one of the quilt flaps of the second like quilt panel into the like second one of the trapezoid quilt pockets to which it is connected and inserting a first quilt flap of the first quilt panel which is in the first configuration in which at least the first one of the quilt flaps extends from the one of the trapezoid quilt pockets to which it is connected.

* * * * *